US006328244B1

(12) United States Patent
Baysinger

(10) Patent No.: US 6,328,244 B1
(45) Date of Patent: Dec. 11, 2001

(54) EASY ARM

(76) Inventor: Glen Edward Baysinger, 1269 Nordin Dr., Fairbanks, AK (US) 99709

( * ) Notice: Subject to any disclaimer, the term of this patent is extended or adjusted under 35 U.S.C. 154(b) by 0 days.

(21) Appl. No.: 09/444,054

(22) Filed: Nov. 19, 1999

(51) Int. Cl.[7] ..... B65H 75/48; G01B 3/10

(52) U.S. Cl. ..... 242/390.8; 242/390.9; 242/394; 33/754; 33/770

(58) Field of Search ..... 242/390.8, 390.9, 242/394; 33/700, 754, 770

(56) References Cited

U.S. PATENT DOCUMENTS

| | | | | |
|---|---|---|---|---|
| 4,915,320 | * | 4/1990 | Neal | 242/390.8 |
| 4,951,890 | * | 8/1990 | Sossamon | 242/390.8 X |
| 5,277,350 | * | 1/1994 | Thornbury, Jr. | 242/390.8 X |
| 6,015,111 | * | 1/2000 | Berke | 242/394 |
| 6,029,391 | * | 2/2000 | Holley et al. | 242/390.8 X |

* cited by examiner

*Primary Examiner*—Donald P. Walsh
*Assistant Examiner*—Minh-Chau Pham

(57) ABSTRACT

The Easy Arm Cable Winder Adapter is a labor and time saving device which allows small diameter cables to be retrieved and wound with an electric drill. The electric drill provides the torque required to retrieve and wind the cable. The Easy Arm Cable Winder Adapter can be modified to work with any brand or type of hand operated down hole instrumentation as well as to retrieve and spool any hand operated cable, wire, tube, line, filament, fiber, thread, string, twine, cord, rope or hose. More specifically, the Easy Arm Cable Winder Adapter significantly reduces the cost, time and effort required to retrieve Slope Indicator Company's Water Level Indicator (meter) cable and wind it back on its spool. Use of the Easy Arm Cable Winder Adapter on a water level meter makes sounding wells significantly faster and requires much less physical labor. The Easy Arm Cable Winder Adapter extends the range of applications for the water level meter and, in some cases, may preclude the use of more expensive technologies.

20 Claims, 2 Drawing Sheets

NOTE: ALL DIMENSIONS IN INCHS.

SIDE VIEW

NOTE: ALL DIMENSIONS IN INCHS.
MOUNTING HOLES ARE ON A 3.25 INCH DIAMETER CIRCLE FOR SLOPE INDICATOR WATER LEVEL INDICATORS.

TOP VIEW

NOTE: ALL DIMENSIONS IN INCHS.

SIDE VIEW

EASY ARM

CROSS REFERENCE TO RELATED APPLICATIONS

Not Applicable

STATEMENT REGARDING FEDERALLY SPONSORED RESEARCH OR DEVELOPMENT

No federal funds or federal organizations were involved in any way with the invention of the Easy Arm Cable Winder Adapter.

REFERENCE TO A MICROFICHE APPENDIX

Not Applicable

BACKGROUND OF THE INVENTION

The Easy Arm Cable Winder Adapter is used in the practical application of hydrology. Hydrology is the science dealing with the properties, distribution and circulation of water. Hydrology is applied in the practice of mining, quarrying, farming, and construction, as well as for domestic, industrial and military water supplies.

Professionals in the fields of mine, civil, geotechnical and environmental engineering, geology, and resource management all employ hydrology from time to time. The most apparent applications of hydrology involve wells that are pumped to provide drinking, irrigation or process water. Wells are also used to dewater construction excavations, quarries, or mines.

Monitoring ground water levels is essential for various reasons. Ground water levels must be observed to maintain, drain, or fill an aquifer. Ground water levels affect the safety and stability of excavations, slopes and structures. Ground water levels effect the economic operation of a construction site, borrow, quarry or mine.

Typically, the hydrologist will measure the levels in pumping and observation wells to help determine the characteristic and performance of aquifers, wells and pumps. In addition to pumping wells and observation wells any opening in the earth may be measured to assist with the interpretation of ground water conditions, including, but not limited to, oil wells, reverse holes, core holes, caverns, shafts, faults, and fissures.

Currently the least expensive technology to monitor water levels in a standpipe piezometer or well is with a water level indicator, also known as a water level meter or dip meter (Slope Indicator Company, 1994). The water level meter consists of a narrow probe attached to a cable or tape and a hand operated cable reel (Slope Indicator Company, 1994). The cable or tape is marked in units of feet or meters (Slope Indicator Company, 1994). The hand operated cable reel is equipped with a built-in light, buzzer or other type of meter (Slope Indicator Company, 1994). The probe is lowered down the well casing or sounding tube until the light or buzzer indicates that the water level has been reached (Slope Indicator Company, 1994). The depth to water is noted from the markings on the cable (Slope Indicator Company, 1994). The probe is recovered by winding the cable back up with a hand crank.

Well depths of 100 to 1,000 feet or more are common and substantial physical effort is required to retrieve and wind the cable. In some cases, a large number of deep wells must be measured or the same well must be measured frequently. Since the process of retrieving the cable takes an increasing amount of effort and time as the depth of the well increases, these wells are typically measured less frequently in order to limit the cost and time involved. This compromise results in less data being available for interpretation. This could result in less efficient or less economic pumping systems. Less frequent data may also retard understanding of the aquifer in question.

The Easy Arm Cable Winder Adapter significantly reduces the cost, time and effort required to retrieve a water level meter cable and wind it back on its spool. The Easy Arm Cable Winder Adapter allows the use of a portable electric drill to retrieve and wind the cable in a single efficient operation. The electric drill provides the torque required to retrieve and wind the cable. Use of the drill with the Easy Arm Cable Winder Adapter makes measuring or sounding water levels significantly faster and requires much less physical labor. Moreover, in some cases, use of the Easy Arm Cable Winder Adapter allows operators to avoid the use of more expensive technology.

Water levels may also be measured with hydraulic (de-aired liquid) piezometers, pneumatic (nitrogen gas) piezometers, electric (strain gage) piezometers, vibrating wire piezometers or vibrating strip piezometers (Slope Indicator Company, 1994). These devices are available from a number of manufactures such as Slope Indicator Company, Geokon, Druk and others. These piezometers (technologies) require dedicated instrumentation in each well, typically making them much more expensive than the water level meter. Currently, when multiple, frequent or deeper observations are required these more expensive technologies are employed. The Easy Arm Cable Winder Adapter extends the range of applications for the water level meter. Use of the more expensive technologies mentioned above might be avoided, in some cases, by utilizing the Easy Arm Cable Winder Adapter.

Water levels in deep larger-diameter wells may also be measured with acoustic sounders. These devices are available from a number of manufactures. Acoustic sounders require relatively large well diameters to function correctly. Acoustic sounders also require access directly above the well, which is not always practical on a routine basis, particularly, if a pump is installed in the well. Acoustic sounders are very expensive. Again, the Cable Winder Adapter extends the range of applications for the water level meter. Utilizing the Cable Winder Adapter, rather than an acoustic sounder may, in some cases allow smaller diameter observation wells to be constructed reducing well costs substantially.

Additional information regarding water level meters is available from Slope Indicator Company, 3450 Monte Villa Parkway, P.O. Box 3015, Bothell, Wash., 98041-3015, USA, telephone (425) 806-2200, facsimile (425) 806-2250 Unrelated to hydrology, the Easy Arm Cable Winder Adapter may also be used with a water level meter to measure liquid levels in or determine the depth of tanks, pipes, or cisterns or any other container. The Easy Arm Cable Winder Adapter can be modified to work with any brand or type of hand operated down hole instrumentation as well as to retrieve and spool any hand operated cable, wire, tube, line, filament, fiber, thread, string, twine, cord, rope or hose.

BRIEF SUMMARY OF THE INVENTION

The Easy Arm Cable Winder Adapter is designed to retrieve and wind cables on Slope Indicator Company's Water Level Indicators (meters) or other water level meters or similar devices with an electric drill. By allowing the use of a one-half inch hand held drill to turn (crank) the reel or spool, the Easy Arm Cable Winder Adapter mechanizes the water level meter cable retrieval process. Utilization of an electric drill with the Easy Arm Cable Winder Adapter results in significant savings of time and physical labor. A battery powered variable speed reversing drill allows the Easy Arm Cable Winder Adapter to be used even in remote locations.

Repeated field tests have shown that the time required to take water level measurements will be reduced by fifty percent or more. Field tests with a DeWalt® 18.5-volt model DWW 995 one-half inch variable speed reversing drill show that cable can routinely be retrieved at 450 feet per minute (7.5 feet per second) in 700 feet deep wells. One DeWalt® 18 volt XR2 battery typically retrieves about 10,000 feet of Slope Indicator Company's Water Level Indicator cable with a ⅜-inch probe attached.

The Easy Arm Cable Winder Adapter significantly reduces operator fatigue allowing more timely or frequent data to be collected. Use of the Easy Arm Cable Winder Adapter will potentially eliminate repetitive motion injuries associated with holding and winding water level meters. The labor savings achieved may also contribute to improved data and operator morale.

BRIEF DESCRIPTION OF THE SEVERAL VIEWS OF THE DRAWING

FIG. 1 shows how to position the FORK on the BASE in relationship to the MOUNTING HOLES.

FIG. 2 shows how to assemble. The BASE, at the bottom of FIG. 2, is attached to the water level meter. The DOWEL at the top of the side view is inserted into the drill chuck for use.

DETAILED DESCRIPTION OF THE INVENTION

The Easy Arm Cable Winder Adapter is designed to retrieve and wind cables on Slope Indicator Company's Water Level Meters or other water meters or similar devices with an electric drill. The Easy Arm Cable Winder Adapter mechanizes the water level meter cable retrieval process saving significant time and physical labor by allowing the use of a one-half inch hand held drill to turn (crank) the reel or spool. A battery powered variable speed reversing drill allows the Easy Arm Cable Adapter Winder to be used even in remote locations.

Repeated field tests have shown that the time required to take water level measurements will be reduced by fifty percent or more. Field tests with a DeWal® 18.5-volt model DWW 995 one-half inch variable speed reversing drill show that cable can routinely be retrieved at 450 feet per minute (7.5 feet per second) in 700 feet deep wells. One DeWalt® 1 8-volt XR2 battery typically retrieves about 10,000 feet of Slope Indicator Company's Water Level Indicator cable with a ⅜-inch probe attached.

The Easy Arm Cable Winder Adapter significantly reduces operator fatigue allowing more timely or frequent data to be collected. Use of the Easy Arm Cable Winder Adapter will potentially eliminate repetitive motion injuries associated with holding and winding water level meters. The labor savings achieved may also contribute to improved data and operator morale.

The Easy Arm Cable Winder Adapter described below is for Slope Indicator Company's 300 foot Water Level Indicator model number 51670830, the 500 foot Water Level Indicator model number 51670050, the 750 foot Water Level Indicator model number 51670075, the 1000 foot Water Level Indicator model number 51670100 or equal with any amount of cable on the spool.

The Easy Arm Cable Winder Adapter will also work with other models or makes of water level meters with modifications, as well as to retrieve and spool any hand operated cable, wire, tube, line, filament, fiber, thread, string, twine, cord, rope or hose. Any of these modifications or variations to the Easy Arm Cable Winder Adapter concept shall still be considered as within the scope of the attached claims.

Figure 1:
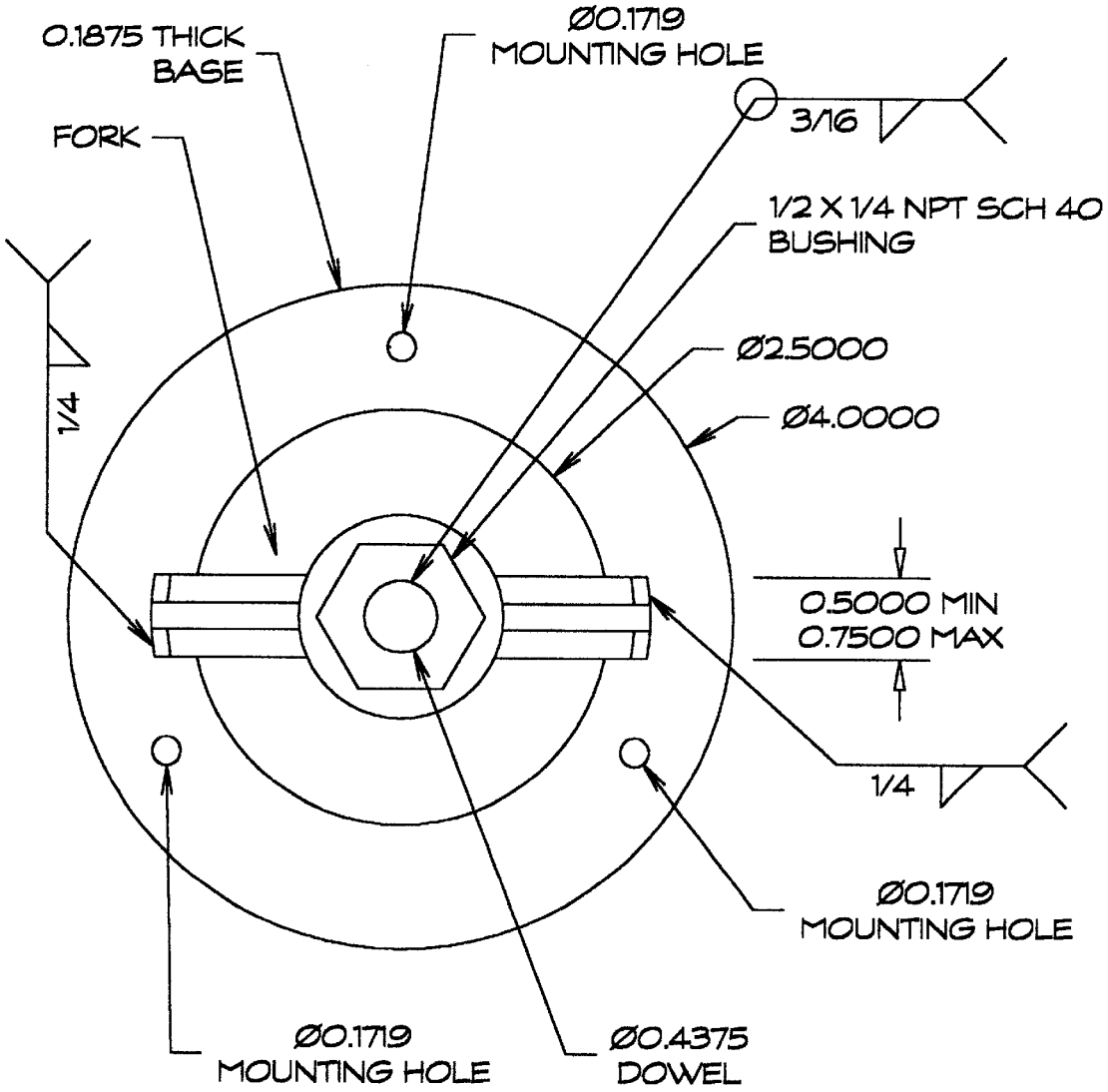
FIG. 1 shows the top view of the completely constructed Easy the DOWEL, BUSHING, FORK and BASE together to form the Easy Arm Cable Winder Adapter Arm Cable Winder Adapter prior to mounting on a water level meter.
Figure 2:
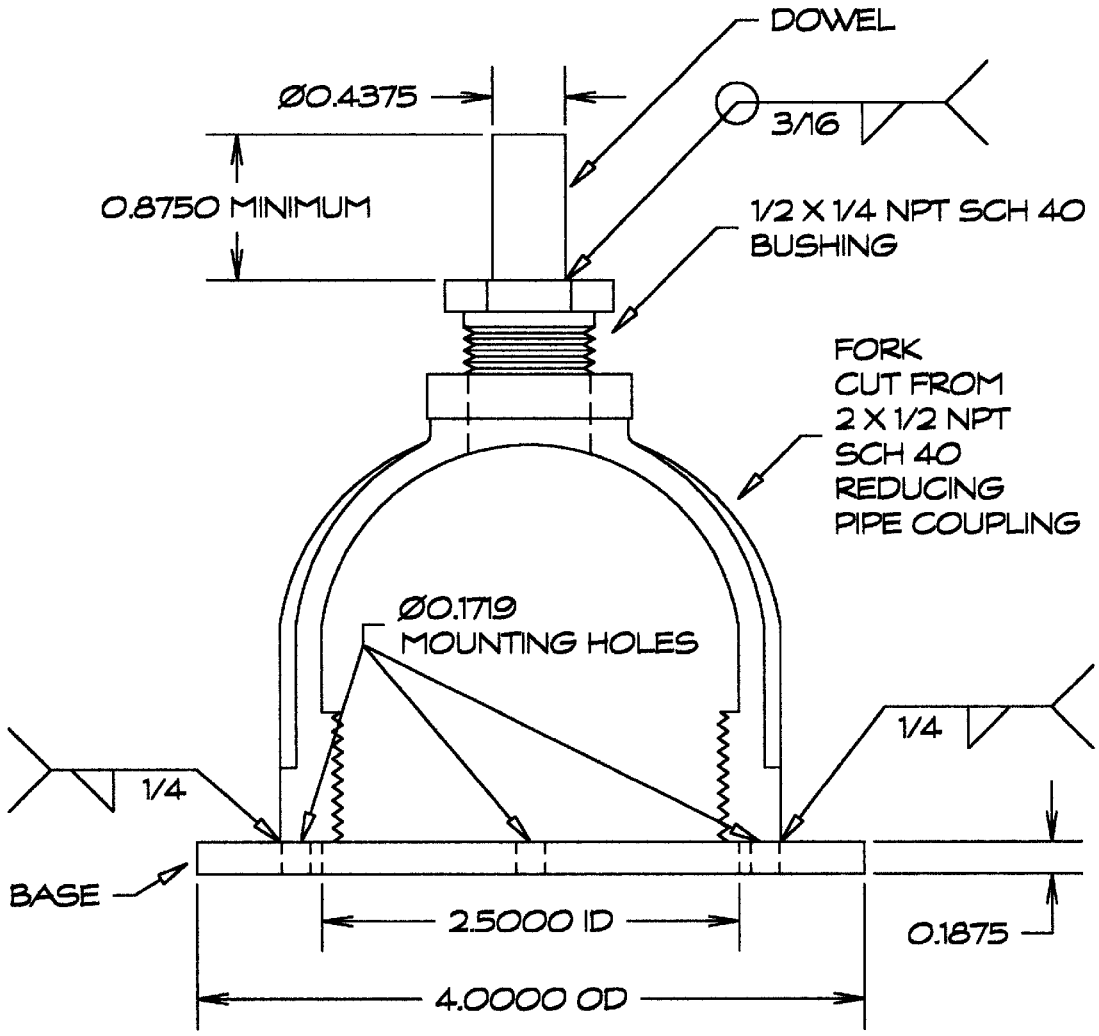
FIG. 2 shows the side view of the completely constructed Easy Arm Cable Winder Adapter prior to mounting on a water level meter.

The Easy Arm Cable Winder Adapter, for Slope Indicator Company's Water Level Indicators, can be constructed by assembling the materials and tools listed in the following sections and then following the step by step instructions below. Please study FIGS. 1 and 2 in conjunction with the following directions to manufacture an Easy Arm Cable Winder Adapter. Materials for the Easy Arm Cable Winder Adapter:

1. Nominal 150 lb. 2 inch NPT by ½ inch NPT standard (schedule 40) Malleable Iron or Steel Reducing Pipe Coupling (1 each)
2. Nominal 150 lb. ½ inch NPT by ¼ inch NPT standard (schedule 40) Malleable Iron or Steel Bushing (1 each)
3. 3/16 inch Plate or 3/16 inch thick, 4 inch outside diameter by 2½ inch inside diameter Flat Washer (1 each)
4. Grade 8, 7/16 inch by 14 threads per inch (NC) by 2½ inch long Bolt with a minimum unthreaded shank length of 1 3/16 inches (1 each)
5. Number 8 by 32 threads per inch (NC) by ¾ inch long Phillips Pan Head replacement Bolts (3 each)
6. EASB 8018 Atom Arc ⅛ inch diameter by 14 inch long welding rod (AWS A5.5; E8018-C3, ASME SFA 5.5, A.B.S.-3Y/AWS a5.5; e8018-C3, L.R.-3.4Y40 (H10), QPL-22200/1:MIL-8018-C3) or equal (1 or 2 sticks)
7. Familian Northwest Four Wire Splice Kit SP4B for wire size 14-12-10 or equal (1 each)
8. Red 3M Scotch® Super 33+ Vinyl Electric Tape 054007-06132¾ inch by 66 feet or equal(1 roll)
9. Yellow 3 M Scotch® Super 33+Vinyl Electric Tape 054007-06132¾inch by 66 feet or equal (1 roll)
10. DeWalt® 18.5 volt cordless ½ inch variable speed reversing adjustable clutch Drill (model number DWW995) with 18 volt XR2 Batteries and Charger or equal. Note a drill is required to bolt construct and operate the Easy Arm Cable Winder Adapter.

Tools for the Easy Arm Cable Winder Adapter;

1. Dayton® 250 amp AC/DC Welder (primary volts 208/230, maximum O.C.V. 78, arc volts 30, primary amps 80/76, secondary amps 250, temperature rise 11 5° C.) or equal
2. 12 inch Hack Saw (with a metal cutting blade)
3. Victor® Journeyman Oxy-Acetylene Welding and Cutting Outfit (with a Victor number 00-1-101 cutting tip) or equal
4. Milwaukee® Variable Temperature Heat Gun (catalog number 8977) 212° F to 1000° F or equal
5. DeWalt® 18.5 volt cordless ½ inch variable speed reversing adjustable clutch Drill (model number DWW995) with 18 volt XR2 Batteries and Charger or equal.

6. 11/64 inch diameter high speed steel Drill Bit
7. Number 2 Phillips Head Screwdriver Construction Instructions for the Easy Arm Cable Winder Adapter 1. Cut off both sides of the 2-inch by ½ inch reducing pipe coupling as shown in drawings to form the FORK. The pipe coupling should be cut so that the rib remains and runs down the center of each leg of the fork. Each leg of the FORK should be a minimum of ½ inch wide and a maximum of ¾ inch wide. If the FORK legs are wider than ¾ inch, then access to the meter controls becomes difficult, and it will be hard to position and weld the FORK to the BASE so as to not interfere with the MOUNTING HOLES.
2. Mark and cut out the BASE from 3/16-inch thick steel plate if a 3/16-inch thick flat washer is not available. Note that some variation in inside and outside diameters are acceptable as long as the washer does not interfere with any controls on the meter and the mounting holes are located approximately half-way between the inner and outer radii of the BASE washer.
3. Drill three 11/64 inch diameter MOUNTING HOLES in BASE washer to match original Number 8 by 32 tpi by ½ inch long bolts (Slope Indicator Company refers to these as "peripheral screws" in their operating instructions) on water level indicator.
4. Set welder at 130 amps DC.
5. Weld the outer FORK legs (the modified 2 inch by ½ inch reducing pipe coupling from step 1) to the BASE washer. Be careful to center the FORK on the BASE washer. Be careful to position the BASE perpendicular to the FORK. Be careful to avoid obstructing any of the MOUNTING HOLES drilled in the BASE (in step 3) with the FORK. Allow to cool.
6. To make the DOWEL, cut off ¾ inch from the threaded end of the Grade 8 7/16-inch diameter bolt and discard the tip (short end). Cut the hex head off the Grade 8 7/16-inch diameter bolt and discard the hex head. The remaining piece should be about 1¾ inch long. Seat the headless 7/16 inch diameter bolt in the ½ inch by ¼ inch BUSHING so that the smooth shank (unthreaded end) of the bolt sticks out ⅞ inch above the hex head of the bushing. The threaded end of the 7/16 inch bolt should be flush (or slightly recessed) with the male threaded (½ inch) end of the bushing.
7. With the modified 7/16-inch diameter bolt seated in the ½-inch by ¼-inch bushing, check that the smooth shank extends at least ⅞ inch beyond the bushing head. Tack weld the bolt to the bushing on the threaded end. If required, file or grind this weld flush, being careful not to damage the outside threads on the bushing. On the shank end of the 7/16 inch bolt, weld the bolt to the bushing head all around. It is important that the bolt is aligned with the bushing or the Easy Arm Cable Winder Adapter may "wobble". Excess wobble will make the water level meter and drill hard to control and will eventually damage the equipment. Allow to cool.
8. Thread bushing into FORK. Note that the bushing is not welded to the FORK and the use of pipe dope is not recommended. The bushing is designed to be easily removed to change batteries and service the water meter, reel or spool.
9. Paint Easy Arm Cable Winder Adapter yellow.
10. Remove the three stock "peripheral screws" (number 8 by 32 tpi (NC) by ½inch long Phillips pan head bolts from the water level meter. Place the Easy Arm Cable Winder Adapter over the bolt holes and fasten to the water level meter with the number 8 by 32 tpi (NC) by ¾ inch long Phillips Pan Head replacement Bolts (3 Each).
11. Mark the water level meter cable with yellow electric tape from 8.2 to 8.6 feet, 9.2 to 9.6 feet, 10.2 to 10.6 feet, 11.2 to 11.6 feet, 12.2 to 12.6 feet, 13.2 to 13.6 feet and 14.2 to 14.6 feet. Wrap the yellow electric tape around the water level meter cable and securely fasten it at the intervals listed above. Make sure that the tape is firmly affixed to the cable and no loose ends are sticking out.
12. Mark the water level meter cable with red electric tape from 3.2 to 3.6 feet, 4.2 to 4.6 feet, 5.2 to 5.6 feet and 6.2 to 6.6 feet. Wrap the red electric tape around the water level meter cable and securely fasten it at the intervals listed above. Make sure that the tape is firmly affixed to the cable and no loose ends are sticking out.
13. Position a Familian heat shrink splice over the ⅜ inch diameter probe where it attaches to the cable on the water level meter. Place the nominal 3 inch long heat shrink so that approximately 2 3/16 inchs of the heat shrink covers the steel probe and ¾ inch of the heat shrink covers the cable. Set heat gun to high and carefully apply the heat to the heat shrink until it is firmly set on the probe and cable.
14. Check the Slope Indicator Company Water Level Meter to make sure the buzzer and light work when the probe encounters water and that the cable is retrieved with no "wobble". If the Easy Arm Cable Winder Adapter was constructed properly the cable will be retrieved smoothly and no wobble will be noticed.

Operating Instructions for the Easy Arm Cable Winder Adapter

1. Always wear a hard hat, safety glasses and snug fitting gloves when operating the Easy Arm Cable Winder Adapter. Some people may not be strong enough to use the Easy Arm Cable Winder Adapter; IF YOU ARE NOT STRONG ENOUGH TO HOLD UP THE REEL AND TO PROVIDE RESISTANCE TO THE DRILL TORQUE THEN PLEASE DO NOT ATTEMPT TO USE THE EASY ARM CABLE WINDER ADAPTER. Generally, if you are not strong enough to repeatedly lower and raise the water level meter probe manually then you will not be able to utilize the water level meter with the Easy Arm Cable Winder Adapter. If you are in doubt, do not attempt to use the Easy Arm Cable Winder Adapter since serious injury may result if the Easy Arm Cable Winder Adapter is used incorrectly or by unfit or unable individuals. Safety First.
2. Set sensitivity as per Slope Indicator Company's (manufacturer's) water level indicator (meter) operating instructions. If you are not using a Slope Indicator Company water level meter then set sensitivity as per the manufacturers instructions.
3. Note how much clearance there is on the spool end when the cable is fully wound on the spool. This is important when rewinding the cable.
4. Lower the probe into the sounding tube or well as per the manufacture's instructions (the Easy Arm Cable Winder Adapter is attached to the reel (spool) but the electric drill is not) as when used manually.
5. Set the drill clutch to provide maximum torque and lock the drill onto the SHAFT of the EASY ARM CABLE WINDER ADAPTER.
6. Center the cable over the well casing or sounding tube to avoid "dragging" the cable against sounding tube and prematurely damaging cable.
7. Hold on to both water level meter TIGHTLY and hold onto electric drill TIGHTLY. It helps to "flip" the reel over and to place the "handle" against your side or hip and hold the stand with your hand.

8. Engage drill quickly to full speed and maintain. Wind the cable evenly on spool by moving it from left to right and back as cable is retrieved. Wind the cable smoothly to prevent cable backlash. It is important to wind the cable clockwise so that bushing is always being tightened. This prevents the Easy Arm Cable Winder Adapter BUSHING from backing out.
9. Pay attention to the amount of cable on the spool as it rewinds. When the spool is nearly full, you can slow the drill by easing up on the trigger. Disengage drill IMMEDIATELY when the yellow tape first appears. If you do not stop the drill in time, the probe will likely hit you in the hands or face. You should always a wear a hard hat, safety glasses, and gloves when operating. IF YOU ARE NOT ABLE TO QUICKLY DISENGAGE THE DRILL WHEN THE YELLOW TAPE FIRST APPEARS, THEN DO NOT USE THE EASY ARM CABLE WINDER ADAPTER.
10. Wind remaining cable slowly with the drill or by hand. Release the drill from the Easy Arm Cable Winder Adapter SHAFT.

What is claimed is:

1. I claim my invention is the concept, system and practical application of using an adapter, consisting of a DOWEL, BUSHING, FORK, a BASE with MOUNTING HOLES, and REPLACEMENT BOLTS, which allows the use of an electric drill to provide the torque required to retrieve and wind any cable, wire, tube, line, filament, fiber, thread, string, twine, cord, rope or hose, spool on a hand operated reel or spool.

2. I claim my invention is an adapter, consisting of a DOWEL, BUSHING, FORK, a BASE with MOUNTING HOLES and REPLACEMENT BOLTS, which allows the use of an electric drill to provide the torque required to retrieve and wind any cable, wire, tube, line, filament, fiber, thread, string, twine, cord, rope or hose on a hand operated reel or spool.

3. The drill in claim 2 being a portable electric drill.

4. The drill in claim 2 being a battery operated portable electric drill.

5. The drill in claim 2 being a battery operated one-half inch portable electric drill.

6. The drill in claim 2 being a battery operated one-half inch variable speed portable electric drill.

7. The drill in claim 2 being a battery operated one-half inch variable speed reversing portable electric drill.

8. The drill in claim 2 being a battery operated one-half inch variable speed reversing adjustable clutch portable electric drill.

9. The drill in claim 2 being an 18.5 volt one-half inch variable speed reversing adjustable clutch electric drill.

10. The drill in claim 2 being a DeWalt® 18.5-volt model DWW995 one-half inch variable speed reversing adjustable clutch electric drill.

11. The BUSHING in claim 2 being removable to facilitate servicing the reel or spool and changing the meter batteries.

12. The MOUNTING HOLES in claim 2 being located and sized to fit to the hand held reel or spool of interest.

13. The cable in claim 2 being attached to any brand or type of probe or instrumentation.

14. The reel and cable in claim 2 being a water level meter (dip meter).

15. The reel and cable in claim 2 being a Slope Indicator Company Water Level Indicator.

16. The reel and cable in claim 2 being a Slope Indicator Company 300-foot Water Level Indicator model number 51670830 or equivalent.

17. The reel and cable in claim 2 being a Slope Indicator Company 500-foot Water Level Indicator model number 51670050 or equivalent.

18. The reel and cable in claim 2 being a Slope Indicator Company 750-foot Water Level Indicator model number 51670075 or equivalent.

19. The reel and cable in claim 2 being a Slope Indicator Company 1000-foot Water Level Indicator model number 51670100 or equivalent.

20. The reel and cable in claim 2 being a Slope Indicator Company Water Level Indicator with any amount of cable, marked in feet or meters, on the spool.

* * * * *